US010443185B2

(12) United States Patent
Koszylko

(10) Patent No.: US 10,443,185 B2
(45) Date of Patent: Oct. 15, 2019

(54) PORTABLE STEAM GENERATOR BASE FOR IRON

(71) Applicant: Spectrum Brands, Inc., Middleton, WI (US)

(72) Inventor: Darek Koszylko, Dane, WI (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/711,318

(22) Filed: Sep. 21, 2017

(65) Prior Publication Data

US 2018/0105974 A1 Apr. 19, 2018

Related U.S. Application Data

(60) Provisional application No. 62/410,126, filed on Oct. 19, 2016.

(51) Int. Cl.

| | |
|---|---|
| ***D06F 75/12*** | (2006.01) |
| ***D06F 75/14*** | (2006.01) |
| ***D06F 75/28*** | (2006.01) |
| ***D06F 75/34*** | (2006.01) |
| ***D06F 75/40*** | (2006.01) |

(52) U.S. Cl.

CPC ..... *D06F 75/12* (2013.01); *D06F 75/14* (2013.01); *D06F 75/28* (2013.01); *D06F 75/34* (2013.01); *D06F 75/40* (2013.01)

(58) Field of Classification Search

CPC ..... D06F 75/12; D06F 75/14; D06F 75/28; D06F 75/34; D06F 79/00; D06F 79/02; D06F 79/025; D06F 79/026

See application file for complete search history.

(56) References Cited

U.S. PATENT DOCUMENTS 1,566,893 A * 12/1925 McArdle ..... D06F 79/00 38/142
2,634,524 A 4/1953 Polivka et al.
2,671,284 A 3/1954 Clemons et al.
(Continued)

FOREIGN PATENT DOCUMENTS

CN 105088733 A 11/2015
EP 1541746 A1 6/2005
(Continued)

OTHER PUBLICATIONS

International Search Report for co-pending PCT/US2017/052740, 6 pages, dated Dec. 7, 2017.

*Primary Examiner* — Ismael Izaguirre
(74) *Attorney, Agent, or Firm* — Kaban Binder, PLLC

(57) ABSTRACT

A portable steam generator includes a steam generator base including a water reservoir and a steam generation unit that is operatively fluidly connected with the water reservoir for water supply to the steam generation unit. The portable steam generator also includes an iron including a sole plate with openings so that steam can pass through the sole plate. The portable steam generator also includes a flexible hose between the steam generation base and the iron including a steam conduit that is operatively fluidly connected with both the steam generation unit and an internal cavity of the iron for supply steam to the iron. A plurality of handles allow grasping and provide portability to the steam generator.

19 Claims, 7 Drawing Sheets

(56) References Cited

U.S. PATENT DOCUMENTS

| | | | | |
|---|---|---|---|---|
| 2,674,819 | A | 4/1954 | Zastrow et al. | |
| 3,783,538 | A | 1/1974 | Von Arnim | |
| 4,565,019 | A * | 1/1986 | Cavalli | B65H 75/4431 38/77.6 |
| D315,433 | S | 3/1991 | Chen | |
| D315,434 | S | 3/1991 | Paulin | |
| 5,371,960 | A | 12/1994 | Wilson et al. | |
| 5,414,945 | A | 5/1995 | Freeman et al. | |
| D374,527 | S | 10/1996 | Gudefin | |
| D379,702 | S | 6/1997 | Gudefin et al. | |
| D388,576 | S | 12/1997 | Gudefin et al. | |
| D388,921 | S | 1/1998 | Doria | |
| 5,842,295 | A | 12/1998 | Ching et al. | |
| D404,864 | S | 1/1999 | Gudefin | |
| D408,107 | S | 4/1999 | Clouet | |
| D423,163 | S | 4/2000 | Stutzer et al. | |
| 6,068,222 | A | 5/2000 | Stangeland | |
| 6,116,550 | A | 9/2000 | Forbes | |
| D439,023 | S | 3/2001 | Powell | |
| 6,212,332 | B1 | 4/2001 | Sham et al. | |
| D452,354 | S | 12/2001 | Hsu | |
| D463,641 | S | 9/2002 | Powell | |
| 6,446,370 | B1 | 9/2002 | Ostermaier | |
| D464,180 | S | 10/2002 | Chen | |
| D470,637 | S | 2/2003 | Berthier | |
| D470,986 | S | 2/2003 | Berthier | |
| D484,658 | S | 12/2003 | Schupp | |
| 7,004,433 | B2 | 2/2006 | Clausen et al. | |
| 7,051,462 | B1 | 5/2006 | Rosenzweig | |
| 7,114,274 | B2 | 10/2006 | Kobayashi et al. | |
| 7,140,580 | B1 | 11/2006 | Hays | |
| 7,210,254 | B2 * | 5/2007 | Docker | D06F 71/29 38/104 |
| D548,418 | S | 8/2007 | Cahen | |
| D564,166 | S | 3/2008 | Yang | |
| D567,463 | S | 4/2008 | Garner | |
| D568,021 | S | 4/2008 | Lebot et al. | |
| D570,570 | S | 6/2008 | Renault | |
| D575,019 | S | 8/2008 | Choi | |
| D576,369 | S | 9/2008 | Choi | |
| D576,370 | S | 9/2008 | Choi | |
| D581,620 | S | 11/2008 | Chu | |
| 7,665,236 | B2 | 2/2010 | Jones et al. | |
| 7,681,343 | B2 | 3/2010 | Dugelay et al. | |
| D617,518 | S | 6/2010 | Choi | |
| 8,109,018 | B2 | 2/2012 | Maurer | |
| 8,132,346 | B1 | 3/2012 | Cooper et al. | |
| D660,538 | S | 5/2012 | Smith | |
| 8,166,679 | B2 | 5/2012 | Lee et al. | |
| 8,353,119 | B2 | 1/2013 | Hanner et al. | |
| D693,083 | S | 11/2013 | Smith | |
| 8,615,908 | B2 | 12/2013 | Collinson et al. | |
| D707,904 | S | 6/2014 | Salagnac | |
| 8,985,325 | B2 | 3/2015 | Otsuka et al. | |
| 9,091,016 | B2 | 7/2015 | Lam et al. | |
| D737,533 | S | 8/2015 | Esteve | |
| D738,059 | S | 9/2015 | Esteve | |
| D738,060 | S | 9/2015 | La Rovere et al. | |
| D738,587 | S | 9/2015 | La Rovere et al. | |
| D745,238 | S | 12/2015 | Orthey et al. | |
| D746,529 | S | 12/2015 | Orthey et al. | |
| 9,284,681 | B1 | 3/2016 | Hays, Jr. | |
| D759,330 | S | 6/2016 | Luang | |
| D759,331 | S | 6/2016 | Salagnac | |
| 9,708,753 | B2 * | 7/2017 | Yoo | D06F 75/16 |
| 2003/0208872 | A1 | 11/2003 | Tsen | |
| 2005/0028408 | A1 | 2/2005 | Tobias et al. | |
| 2008/0052971 | A1 | 3/2008 | Giovalle et al. | |
| 2008/0209774 | A1 | 9/2008 | Robin | |
| 2010/0058625 | A1 | 3/2010 | Lin et al. | |
| 2012/0131823 | A1 * | 5/2012 | Tsang | D06F 75/12 38/77.83 |
| 2013/0131823 | A1 | 5/2013 | Morrey et al. | |

FOREIGN PATENT DOCUMENTS

| | | | |
|---|---|---|---|
| EP | 1612320 | A1 | 1/2006 |
| EP | 1707525 | A1 | 10/2006 |
| EP | 000792643 | | 10/2007 |
| EP | 001024806 | | 11/2008 |
| EP | 1910604 | B1 | 3/2009 |
| EP | 1951951 | B1 | 5/2010 |
| EP | 2636790 | A1 | 9/2013 |
| EP | 2596163 | B1 | 9/2015 |
| EP | 2933372 | A1 | 10/2015 |
| EP | 3002363 | A1 | 4/2016 |
| GB | 764218 | | 12/1956 |
| JP | 60068900 | A * | 4/1985 |
| WO | 02081810 | A1 | 10/2002 |
| WO | 03066953 | A1 | 8/2003 |
| WO | 2007012720 | A1 | 2/2007 |
| WO | 2008097189 | A1 | 8/2008 |
| WO | 2010006548 | A1 | 1/2010 |
| WO | 2010072557 | A1 | 7/2010 |
| WO | 2010072558 | A1 | 7/2010 |
| WO | 2010132184 | A1 | 11/2010 |
| WO | 2011076545 | A1 | 6/2011 |
| WO | 2012011021 | A2 | 1/2012 |
| WO | 2012153242 | A2 | 11/2012 |
| WO | 2012164463 | A2 | 12/2012 |
| WO | 2012164471 | A1 | 12/2012 |
| WO | 2014013360 | A2 | 1/2014 |

* cited by examiner

PORTABLE STEAM GENERATOR BASE FOR IRON

CROSS-REFERENCE TO RELATED APPLICATIONS

This application claims the benefit of U.S. Provisional Patent Application No. 62/410,126, filed Oct. 19, 2016, the entire contents of which are incorporated herein by reference in its entirety.

FIELD OF THE INVENTION

The present invention is directed to a portable steam generator base including a water reservoir and a steam generator as such base is operatively connected to and usable along with an attached iron.

BACKGROUND OF THE INVENTION

Steam irons are well known as providing a clothes smoothing device comprising a water reservoir within the iron body and comprising a heated sole plate having a surface for contacting clothing. Water may be heated by the sole plate or a separate heater to create steam that can be continuously delivered through holes of the sole plate or may be controlled to be delivered as a response to activation by a trigger or the like or as a result of certain sensed conditions.

More recently, steam generators have been developed that utilize an iron as such is provided with a heated sole plate but without a water reservoir, wherein the iron is connected with a steam generation base unit that includes a water reservoir and a heating device for creating steam. The steam and usually electrical power are delivered to the iron by way of a steam conduit and electrical wires that are provided within a flexible hose that allows the iron to be manipulated independently of the base unit.

Typically, the steam generation base unit and iron device are also physically connectable to each other, such as by a latching mechanism of a mechanical type. The iron is also then releasable from the base unit by unlatching of the mechanism for use. The iron itself of such a steam generator is typically designed like a conventional iron having a handle portion to allow manipulation of the iron, in particular its sole plate, for steaming and pressing clothing or the like. As compared with a conventional iron, a stream generator can produce a much greater quantity of steam over longer time since the steam is generated within the base unit, which is typically larger than an iron and includes a bigger water reservoir and more powerful steam generator.

A water reservoir of a steam generator is typically provided so as to be refillable with water either by providing an access to the reservoir as positioned within the steam generator or by providing a removable reservoir. Either way, the reservoir is sized and shaped to hold a sufficient quantity of water based upon the needs for typical usage. The larger the steam generator, the greater the potential for water capacity of the water reservoir, and the greater the weight of the unit itself. A competing desire is to keep the steam generator unit portable. Water as provided within a water reservoir also adds very significantly to the weight of the unit.

Prior art steam generators typically rely on the handle of the iron as such is already a necessity so as to permit manipulation of the iron during usage for steaming and/or pressing a garment or the like. This is possible by including a latching mechanism, as noted above, that can selectively lock the iron and steam generation base unit together so that they are portable together. The iron handle thus permits the base unit to move with the iron when they are locked together.

SUMMARY OF THE INVENTION

The present invention overcomes shortcomings of the prior art steam generators in providing an iron and steam generator base combination where the combination is portable as facilitated by plural handle positions provided to the steam generation base unit. Such a combination allows portability of the combination without having to lock or latch the iron and base unit together. Moreover, by positioning the plural handles on the steam generator base at ergonomic locations, the combination can be moved about more easily in that the user can lift the combination at plural points for weight distribution. This can also allow for the design of units of greater capacity and/or weight.

According to a first aspect of the present invention, a portable steam generator includes a steam generator base including a water reservoir and a steam generation unit that is operatively fluidly connected with the water reservoir for water supply to the steam generation unit. The portable steam generator also includes an iron including a sole plate with openings so that steam can pass through the sole plate. The portable steam generator also includes a flexible hose between the steam generation base and the iron including a steam conduit that is operatively fluidly connected with both the steam generation unit and an internal cavity of the iron for supply steam to the iron. The portable steam generator also includes a plurality of handles that allow grasping and that provide portability to the steam generator.

DETAILED DESCRIPTION OF THE PREFERRED EMBODIMENTS

Figure 2:
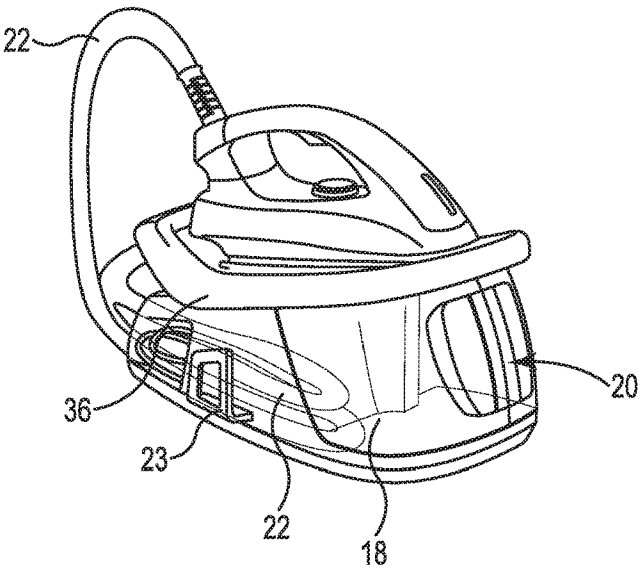
FIG. 2 is a perspective view of the steam generator of FIG. 1 also showing a flexible hose connecting the iron and steam generator base to facilitate steam passage from the steam generator base to the iron and to allow for electrical connection between them.
Figure 1:
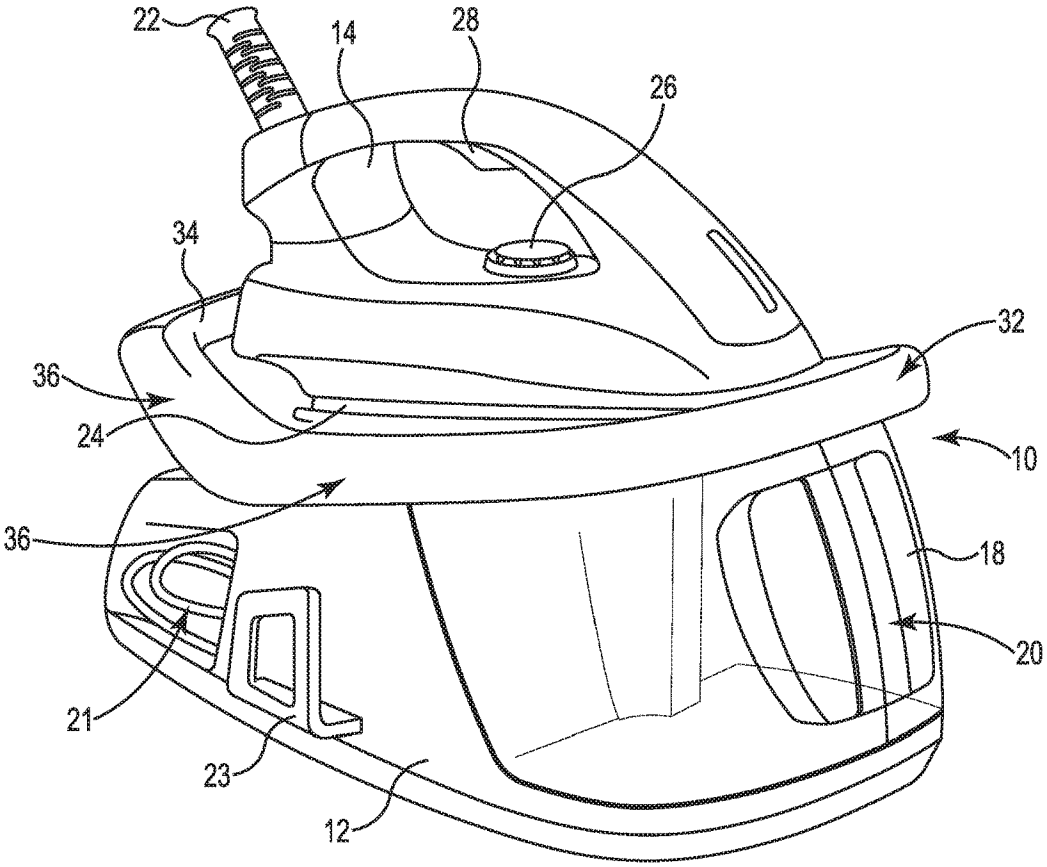
FIG. 1 is a perspective view of a steam generator in accordance with the present invention comprising a steam generator base and a removable iron that are positioned together.
Figure 3:
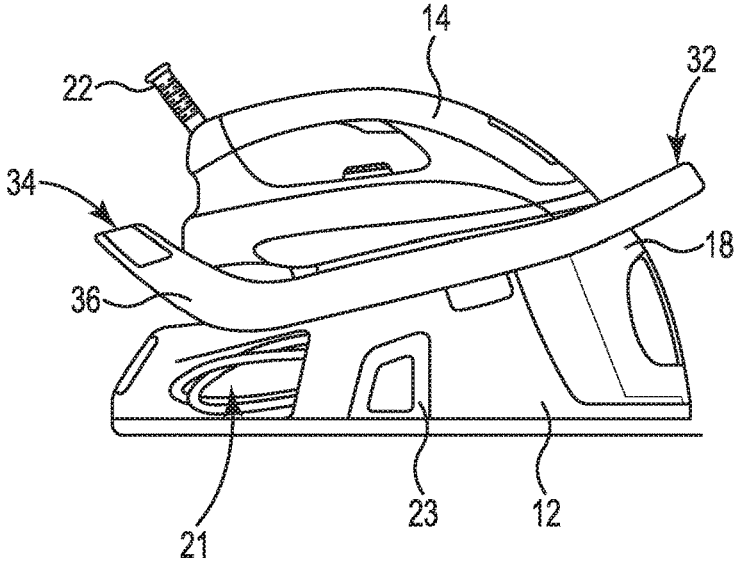
FIG. 3 is a side view of the steam generator of FIG. 1 showing the iron positioned to the steam generator base and illustrating front and back handles or gripping portions of the steam generator base and in accordance with an embodiment of the present invention.

The present invention is directed to a steam generator 10, as illustrated in FIG. 1, that comprises a combination of a steam generator base 12 and an iron 14. It is noted that like components are labelled with like numerals throughout the several figures. A steam generator 10 is useful for steaming garments and the like, wherein the steam generator base 12 can provide significantly more steam in quantity and flow rate to the iron 14, as compared with a conventional steam iron. A steam generator 10 of the present invention provides desirable steam production by way of a unit with improved portability.

The steam generator base 12 is shaped to support the iron 14 on a top surface 16 thereof. Preferably, the top surface 16 is inclined to position the iron 14 in an ergonomic position for a user. The steam generator base 12 also preferably houses a number of operative components to provide a supply of steam from the steam generator base 12. Specifically, a water reservoir 18 provides a refillable supply of water that can be turned into steam. It is preferable that the size of the water reservoir 18 be sufficient to supply a desired quantity of steam at a desired rate from the iron 14, as further discussed in detail below.

The water reservoir 18 is also preferably removable from the steam generator base 12 for filling and refilling with water. In the shown embodiment, the water reservoir 18 comprises a slidable component, like a drawer, that is slidably supported to move within the steam generator base 12 and to be removable for filling. Slide components (not shown) can include commercially available slide devices that can be mounted within the interior of the steam generator base 12, or the steam generator base 112 can be formed with integral components that provide slide bearing surfaces to guide the water reservoir 18 within the steam generator base 12. Otherwise, the water reservoir 18 can simply be removed from the steam generator base 12, which action may require manipulation of latching mechanism, or the removal of a component for access or not. As shown, the water reservoir 18 can be formed with a handle portion 20 that allows for easy manipulation of the water reservoir 18 to and from the steam generator base 12. The water reservoir 18 can also be transparent, as illustrated, so that a water level therein can be easily ascertained.

Also within the steam generator base 12, the water reservoir 18 is operatively fluidly connected with a steam generation unit or boiler (not shown), the function of which is to heat and boil water from the water reservoir 18 and supply steam from the steam generator base 12. A fluid transport hose (not shown) can fluidly connect the water reservoir 18 to the steam generation unit in order to supply water to the steam generation unit. Steam generation units are well-known, per se, and examples thereof are described within the following references, that are fully incorporated herein by reference. U.S. Pat. Nos. 9,404,649 and 8,615,908 and EP published patent application EP 1486725 all disclose examples of steam generation units that can be incorporated within a steam generator of the present invention. Moreover, fluid connection to and from the steam generation unit can be accomplished with conventional hoses, connectors, clamps, and the like for handling the fluid transport of water and steam, respectively. The steam generation unit can be fixed within the interior space of the steam generator base 12 in any known or developed manner. Also, one or more pumps can be utilized for assisting in the fluid flow of either the water or steam as may be desirable or necessary.

The steam generation unit can also be conventionally controlled. A control unit (not shown) may be mounted to the steam generator base 12 at any convenient location, which control unit can be used to control the quantity and/or rate of steam production. The control unit can set a temperature of a heating element, a duration of temperature exchange, a quantity of water supply and/or flow rate, among other things. The steam generator base 12 is also preferably connectable to a power source, such as conventional line power, by a cord or the like to provide electrical power to operate the control unit, the steam generation unit, any pumps or the like, and preferably also to the iron 14, as discussed below. A power cord can be accommodated within a portion of the steam generator base 12 as shown at 21. Cord reels and the like can be incorporated as desired.

Connected between the steam generator base 12 and the iron 14 is a flexible hose 22 that preferably provides a conduit within which both a steam transport line and an electrical cord can be contained. The flexible hose 22 can utilize conventional connectors, clamps, and the like to make the appropriate connections with the steam generator base 12 and the iron 14. A steam transport line (not shown) can be operatively fluidly connected, as discussed above, with the steam generation unit within the steam generator base 12 and can also be operatively fluidly connected with an interior space of the iron 14 in any conventional manner. From the interior of the iron 14, steam can be delivered through the iron's sole plate 24 by way of steam holes, as such are also conventionally known. Electrical power is preferably delivered from the steam generator base 12 (as such can be operatively connected to power) to the iron 14 by the electrical cord. Electrical power can be used to heat the sole plate 24 and to provide control power to an iron control unit having a user control 26, for example, for setting the desired temperature of the sole plate 24. A trigger 28 is also preferably provided for selectively delivering steam from the sole plate, which triggers and delivery control elements are also well-known.

A length of the flexible hose 22 provides a range of movement of the iron 14 relative to the steam generator base 12. This allows a user to move about a garment or the like from a single position of the steam generator base 12. A handle portion 30 of the iron 14 provides a gripping feature for a user to manipulate the iron 14. A hose bracket 23 can be provided from the steam generator base 12, for example, to facilitate stowing of the hose 22, especially during any movement of the steam generator 10.

However, it is still desirable that the steam generator 10, including the combination of the steam generator base 12 and iron 14, be sufficiently portable to be moved about by a user so that the steam generator 10 can be used at any desired location. As discussed above in the Background section, the handle portion 30 can be utilized for the purpose of moving the steam generator 10 about. However, that requires that the iron 14 be physically connected with steam generator base 12 at least during the period that the steam generator 10 is being moved about. It is contemplated that any known or developed latching or temporary connection mechanism or material can be utilized with steam generators 10 of the present invention, but such is not necessary.

Figure 5:
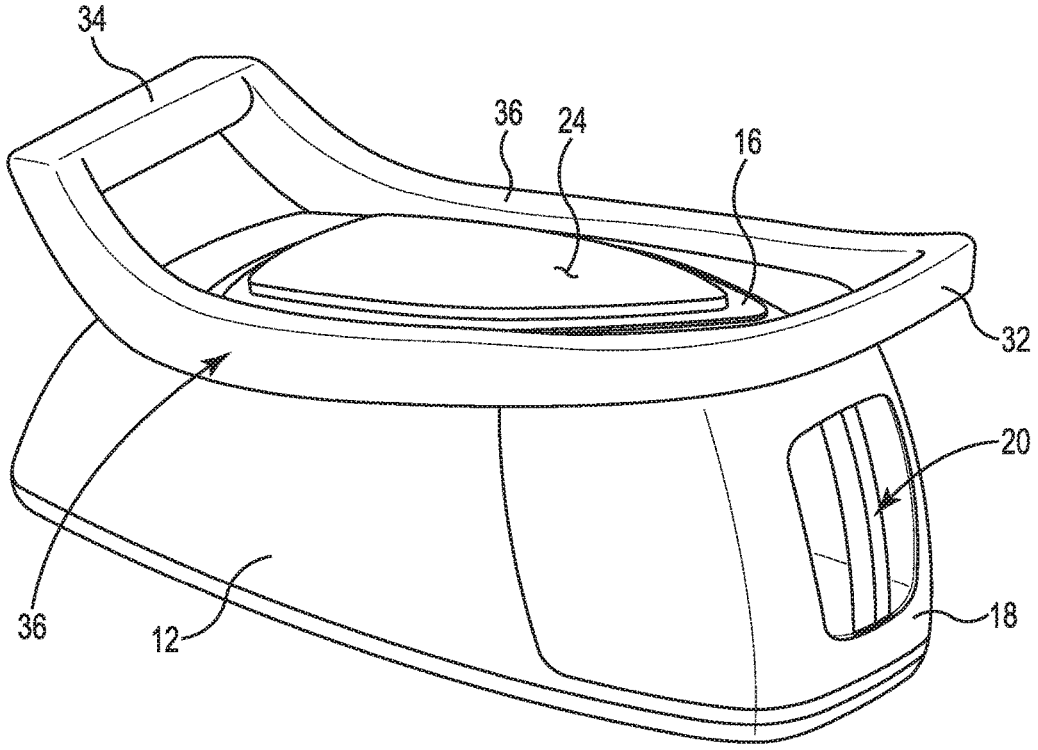
FIG. 5 is a perspective view of the steam generator base of FIG. 1 with a central top surface thereof for receiving an iron and also showing front and rear handles.

As noted above, the iron 14 can simply sit on top surface 16 of the steam generator base 12. FIG. 5 illustrates just the sole plate 24 portion of iron 14 as such is positioned on the surface 16. Preferably, the surface 16 includes a recess for receiving at least a portion of the thickness of the sole plate 24. More preferably, such a recess is sized and shaped to receive the shape of the sole plate 24 so that the iron 14 will not slide around relative to the top surface 16 of the steam generator base 12 during movement of the steam generator 10 or at any other time. However, in accordance with a preferred embodiment of the present invention, no locking or latching mechanism or material is provided to temporarily secure the iron 14 to the steam generator base 12. A user can simply lift the iron 14 from the top surface 16 of the steam generator base 12 or out of a recess, if provided on the surface 16. It is contemplated that other features or materials can be provided to inhibit or prevent movement of the sole plate 24 to the surface 16 without locking or latching the iron 14 with the steam generator base 12. The sole plate 24 may be contacted at only two or more points by one or more features of the top surface 16 to do so. Otherwise, certain materials can be chosen for at least a portion of the top surface 16 to inhibit or prevent sliding movement of the sole plate 24.

In accordance with an aspect of the present invention, plural handles are provided to the steam generator base 12 as gripping zones for a user to grasp and move the portable steam generator 10 about. Preferably, the handles are arranged in an ergonomic manner to allow easy movement of the steam generator 10 by a user from one location to another. Moreover, if the water reservoir 18 of the steam generator base 12 contains a quantity of water, plural handles are beneficial for weight distribution and thus movement of the steam generator 10.

Figure 4:
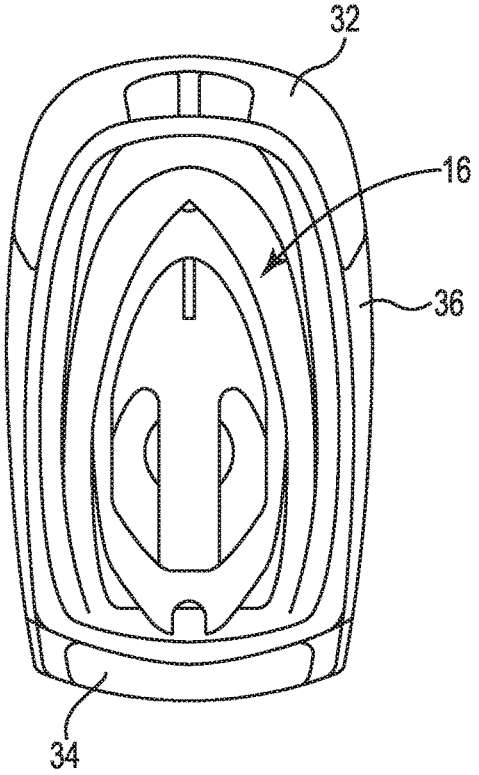
FIG. 4 is a top view of the steam generator of FIG. 1 showing the iron positioned within a central zone of a top surface of the steam generator base with the front and rear handles positioned forward and rearward of the iron front and back portions.

In a preferred embodiment, a front handle 32 and a rear handle 34 are provided as being operatively fixed with the steam generator base 12. This embodiment provides a balanced design to the steam generator 10 where a user grips the unit at the front and rear for movements. During movement, the iron 14 can be unsecured to the steam generator base 12, as discussed above. As shown in FIG. 4, the iron 14 is positioned to the top surface 16 of the steam generator base 12. The front handle 32 and rear handle 34 of the steam generator base 12 are provided so as to extend sufficiently forward and rearward, respectively, of the iron front portion and rear portion, as positioned on the top surface 16. This allows the iron 14 to be easily positioned on and removed from the steam generator base 12 without obstruction by either of the handles 32 or 34.

As illustrated, the front and rear handles 32 and 34 preferably extend higher than the top surface 16 to also facilitate easy grasping by a user. In the illustrated embodiment, the front and rear handles are provided as portions of an integral handle unit 36. Instead, the handles 32 and 34 can be independently provided as either separate elements from each other or from the steam generator base 12, or can be integral with the steam generator base 12 and separate from each other. Any usable arrangement is contemplated.

As shown in FIG. 5, an integrated handle unit 36 can be fixed near the top surface 16 of the steam generator base 12. Such a unit 36 can be a single element that extends entirely around the top surface 16. The handle unit 36 can be secured to the steam generator base 12 by any known or developed technique including the use of mechanical fasteners, adhesives, heat welds, or the like, or the unit 36 can be formed integrally with one or more portions of the steam generator base 12 itself.

The handle unit 36 can be designed to follow an incline and/or contour of the top surface 16 of the steam generator base 12. Preferably, the handle unit 36 is shaped similar to and secured to the upper perimeter of the steam generator base 12 along upper side portions of the steam generator base 12 with the front and rear handles 32 and 34 extending away from the steam generator base 12. The front handle 32 and rear handle 34 can be provided at a similar elevation, although with different lengths of extension from the steam generator base 12 horizontally and/or vertically. For example (as shown in FIG. 5), a rear portion of the handle unit 36 can slope more quickly upwardly from the steam generator base 12 to the rear handle 34 than the front handle 32 does from a front portion of the handle unit 36. This example provides the front and rear handles 32 and 34 to be at a similar elevation although extending differently vertically from the inclined top surface 16.

Figure 6:
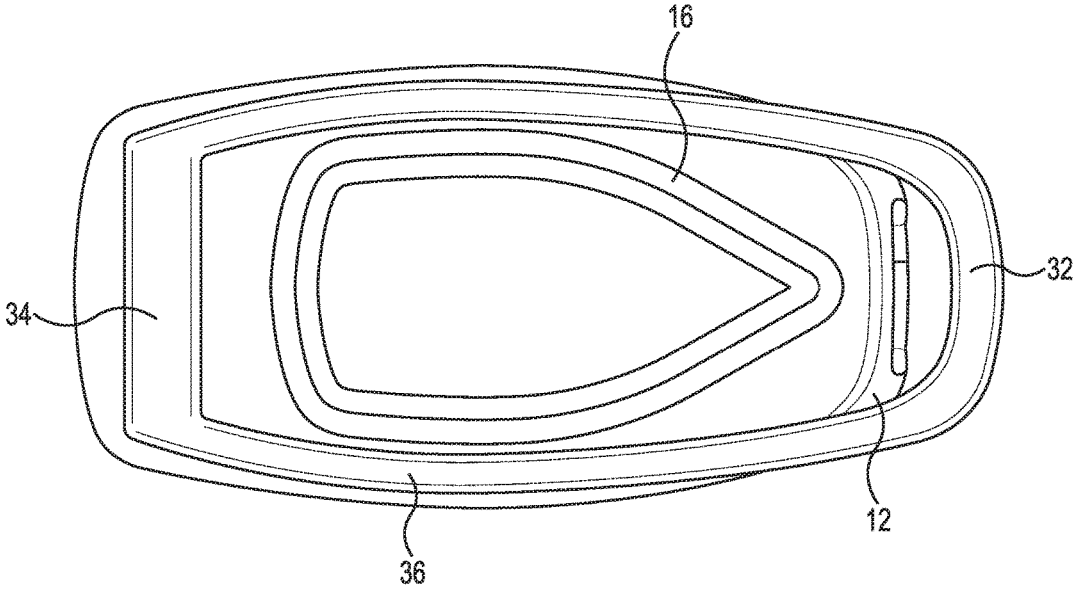
FIG. 6 is a top view of the steam generator base as such is illustrated in FIG. 5.
Figure 7:
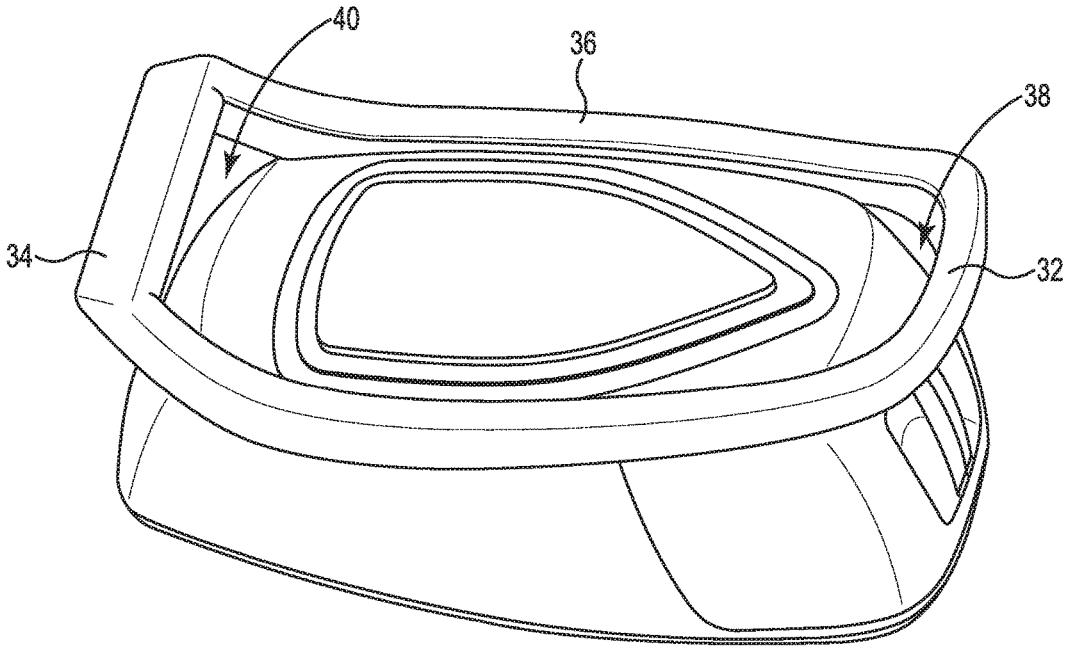
FIG. 7 is a view similar to FIG. 5 and showing the front and rear handles as provided relative to the steam generator base.

FIG. 6 shows an arrangement of the front handle 32 to the rear handle 34 where the front handle 32 extends further horizontally with respect to the steam generator base 12 than does the rear handle 34. As shown in FIG. 7, this preferred design allows sufficient front and rear user hand access by way of the created front gap 38 and rear gap 40.

Figure 8:
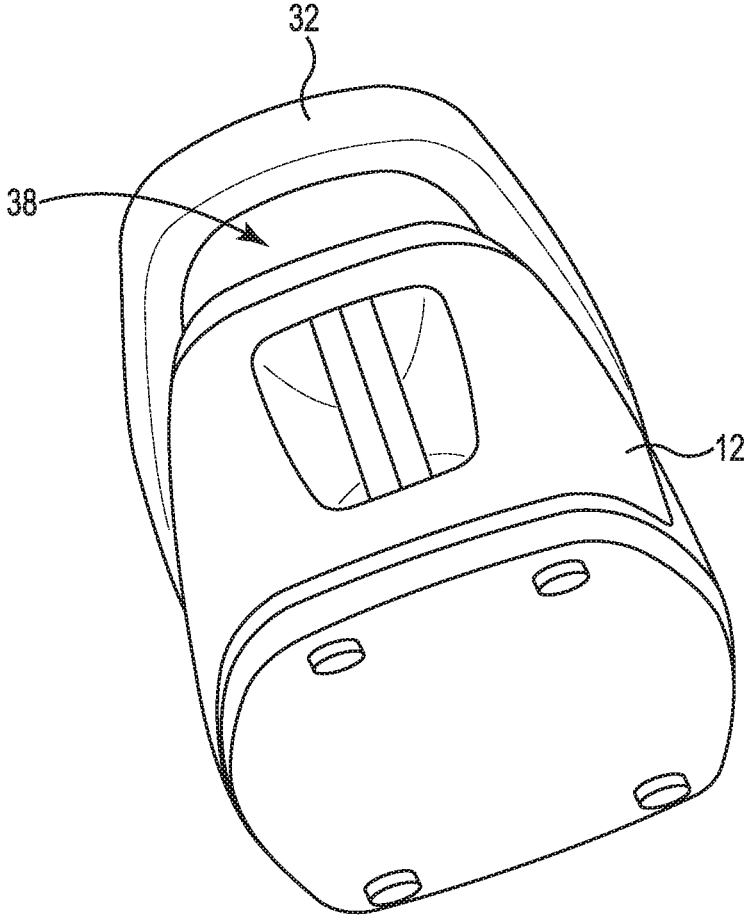
FIG. 8 is a view of the steam generator base as shown in FIG. 5 illustrating the front handle as such is positioned relative to the steam generator base.
Figure 9:
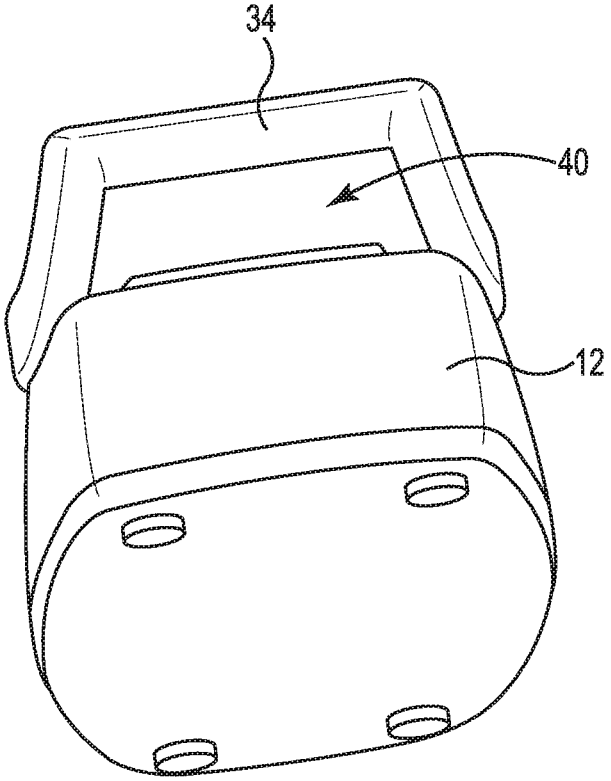
FIG. 9 is a view of the steam generator base as shown in FIG. 5 illustration the rear handle as such is positioned relative to the steam generator base.

FIGS. 8 and 9 further illustrate the gaps 38 and 40 of the front and back handles 32 and 34, respectively, as being different in not only size but shape based upon horizontal and vertical differences relative to the steam generator base 12. It is contemplated that any shape and sizing of the handles and gaps can be provided. It is, however, preferable that each handle 32 and 34 be designed to be ergonomically friendly to a user and to allow for easy passage of a user's hand through the gaps 38 and 40.

It is also contemplated that other handle designs can be made in accordance with the present invention. A similar design could be provided as shown if FIGS. 1-9, but with the handles provided at the sides of the steam generator base 12 instead of the front and rear. Other arrangements can be provided based upon the size and shape of the steam generator base 12. The steam generator base 12 is illustrated as having a longitudinal length and a transverse width with the handles 32 and 34 spaced longitudinally. It is contemplated that the steam generator base can be other shapes, such as circular, square, rectangular, etc. It is preferable that plural handles be provided that are directly or indirectly fixed to the steam generator base 12, no matter the shape, to allow for portability of the steam generator 10, more preferably without the need to lock or latch the iron 14 to the steam generator base 12. It is also preferable that the plural handles be provided so as to be substantially opposed to each other to allow for a balanced design. For a design as shown, a preferable arrangement is either front and rear or side to side for balancing. In the case of a circular shaped base, the handles can be diametrically opposed to each other. It is understood that handle placement and design might also be altered to accommodate uneven weighting of the steam generator 10, such as when the water reservoir 18 is variously partially or fully filled with water.

The invention claimed is:

1. A portable steam generator, comprising:

a steam generator base including a water reservoir and a steam generation unit that is operatively fluidly connected with the water reservoir for water supply to the steam generation unit;

an iron including a sole plate with openings so that steam can pass through the sole plate; and a flexible hose between the steam generation base and the iron including a steam conduit that is operatively fluidly connected with both the steam generation unit and an internal cavity of the iron for supply steam to the iron;

wherein the steam generator base further comprising a top iron receiving surface for receiving the sole plate at a specific orientation and for positioning the iron on the top of the steam generator base above the water reservoir and without mechanical connection between the iron and the steam generator base, and the steam generator base further includes a plurality of handles that allow grasping and that provide portability to the steam generator with a pair of the handles non-movably positioned at opposite sides of the top iron receiving surface so that the top receiving surface and thus the iron lies between the pair of handles.

2. The portable steam generator of claim 1, wherein a first handle and a second handle are spaced from each other longitudinally with respect to the steam generator base.

3. The portable steam generator of claim 2, wherein the first and second handles are provided at a front portion of the steam generator base and a rear portion of the steam generator base, respectively.

4. The portable steam generator of clam 3, wherein the first and second handles are provided at substantially similar elevations to each other.

5. The portable steam generator of claim 3, wherein first and second gaps are created between the first and second handles and the steam generator base, respectively.

6. The portable steam generator of claim 5, wherein the first and second handles each are fixedly connected with the steam generator base to be positioned away from the steam generator base and to create the first and second gaps.

7. The portable steam generator of claim 6, wherein the first and second handles are provided integrally with each other as a handle unit.

8. The portable steam generator of claim 7, wherein the handle unit is shaped similar to and secured to an upper perimeter of the steam generator base along upper side portions of the steam generator base with the first and second handles extending away from the steam generator base.

9. The portable steam generator of claim 1, wherein steam generator base is configured to inhibit movement of the sole plate with respect to a top surface of the steam generator base without locking or latching the iron with the steam generator base.

10. The portable steam generator of claim 9, wherein at least a portion of the top surface is composed of materials configured to inhibit or prevent sliding movement of the sole plate with respect to the top surface.

11. The portable steam generator of claim 9, wherein the sole plate is contacted at two points of the top surface by one or more features of the top surface.

12. The portable steam generator of claim 1, wherein the first and second handles are provided such that the iron is positionable on and removable from the steam generator base without obstruction by the first or second handles.

13. The portable steam generator of claim 1, wherein the first and second handles are independently provided as separate elements from each other.

14. The portable steam generator of claim 1, wherein the first and second handles are independently provided as separate elements from the steam generator base.

15. The portable steam generator of claim 1, wherein the handle unit is configured to follow an incline and a contour of the top surface of the steam generator base.

16. The portable steam generator of claim 4, wherein the first and second handles are provided with different lengths of extension from the steam generator base horizontally or vertically.

17. The portable steam generator of claim 16, wherein the first handle extends further horizontally with respect to the steam generator base than does the second handle.

18. The portable steam generator of claim 6, wherein each or the first and second handles is configured to permit a passage of a user's hand through the first and second gaps.

19. The portable steam generator of claim 1, wherein the first and second handles are positioned to accommodate uneven weighting of the steam generator base when the water reservoir is partially filled with water.

* * * * *